United States Patent [19]

Rencin et al.

[11] 3,974,665

[45] Aug. 17, 1976

[54] YARN BREAKAGE DETECTION CIRCUITRY FOR KNITTING MACHINES

[75] Inventors: Miloslav Rencin, Privrat; Josef Rod, Usti nad Orlici; Pavel Seidl, Usti nad Orlici, all of Czechoslovakia

[73] Assignee: Elitex, Zavody textilniho strojirenstvi, generalni reditalstvi, Liberec, Czechoslovakia

[22] Filed: Oct. 1, 1975

[21] Appl. No.: 618,577

[30] Foreign Application Priority Data

Oct. 1, 1974 Czechoslovakia ..... 6711-74

[52] U.S. Cl. ..... 66/163; 57/81; 340/259

[51] Int. Cl.[2] ..... D04B 35/12

[58] Field of Search ..... 66/157, 163, 158, 161; 200/61.13–61.18; 242/57; 57/81; 340/259; 307/116–119, 112

[56] References Cited

UNITED STATES PATENTS 3,561,089 2/1971 Morgan..... 200/61.14

*Primary Examiner*—Ronald Feldbaum

[57] ABSTRACT

A magnetically responsive circuit is arranged in the yarn breakage detection portion of a knitting machine for providing a visual indication of yarn breakage and for simultaneously switching the operating state of a drive coil-actuated clutch which feeds yarn into the machine. The drive coil is serially connected with a magnetically actuated reed switch which responds to the detection of yarn breakage to switch the operating state of the drive coil. A normally disabled lamp or other illumination device is connected to the drive coil and to the switch by means of a diode. The diode is poled to maintain the lamp disabled while the switch remains unoperated, and to energize the lamp when the switch is operated in response to a detection of yarn breakage.

5 Claims, 3 Drawing Figures

YARN BREAKAGE DETECTION CIRCUITRY FOR KNITTING MACHINES

BACKGROUND OF THE INVENTION

The invention relates to yarn breakage detection circuits in knitting and other textile machines, and more particularly to circuitry within such detection arrangements for indicating the breakage visually and for stopping or otherwise altering a clutch drive which feeds the yarn into the knitting machine.

In known circuits of this type, the drive coil of a yarn-advancing clutch, illustratively a friction clutch, is normally maintained in a conductive state appropriate to permit the clutch to advance yarn into the machine. The conductive state of the drive coil is conventionally controlled by a transistor or other semiconductive device, whose control electrode is switched upon the occurence of a yarn breakage. A lamp or other suitable illumination device is connected to a reed switch, which is magnetically operated to excite the lamp simultaneously with the excitation of the control electrode of the coil-controlling transistor, i.e., upon the occurrence of a yarn breakage in the knitting machine.

The necessity, in such arrangements, of employing an active semiconductive control device for regulating the conductive state of the clutch drive coil leads not only to relatively high complication and expense of the detection circuitry, but also to relatively high susceptability of the circuit to noise disturbances and to changes of parameters of the circuit caused by changes in temperature and the like.

SUMMARY OF THE INVENTION

Such disadvantages are overcome with the circuit arrangement of the invention, which employs relatively rugged and insensitive magnetically operated switching arrangements for both changing the conductive state of the clutch drive coil and for energizing the illumination lamp upon the detection of a yarn breakage.

In an illustrative embodiment, the clutch drive coil is serially connected in a first circuit path with a magnetically operated switch, such as a reed switch, which is operative from a first to a second state upon the occurrence of a yarn breakage. The illumination lamp, which is preferably serially connected with a limiting resistor in a second circuit path, is coupled to the first circuit path by means of a diode which is poled to maintain the lamp disabled while the reed switch remains unoperated, and which permits the excitation of the lamp upon the operation of the reed switch.

In the case where the clutch is a friction-type clutch whose drive coil is maintained energized during normal conditions, the reed switch is normally maintained conductive and is operated into a non-conductive state upon a yarn breakage. In such case, the second circuit path including the resistor and the lamp is connected in parallel with the first path including the drive coil and the normally conductive reed switch, and the diode is connected between the junction of the resistor and lamp and the junction of the drive coil and reed switch.

In the case where the clutch is of the claw-type whose drive coil is maintained unenergized during normal conditions, the reed switch is arranged to be normally nonconductive and to be operated into a conductive state upon a yarn breakage. In such case, the diode is connected in series with the lamp and the resistor across the drive coil of the first path.

BRIEF DESCRIPTION OF THE DRAWING

The invention is further set forth in the following detailed description taken in conjunction with the appended drawing, in which.

DETAILED DESCRIPTION

Figure 1:
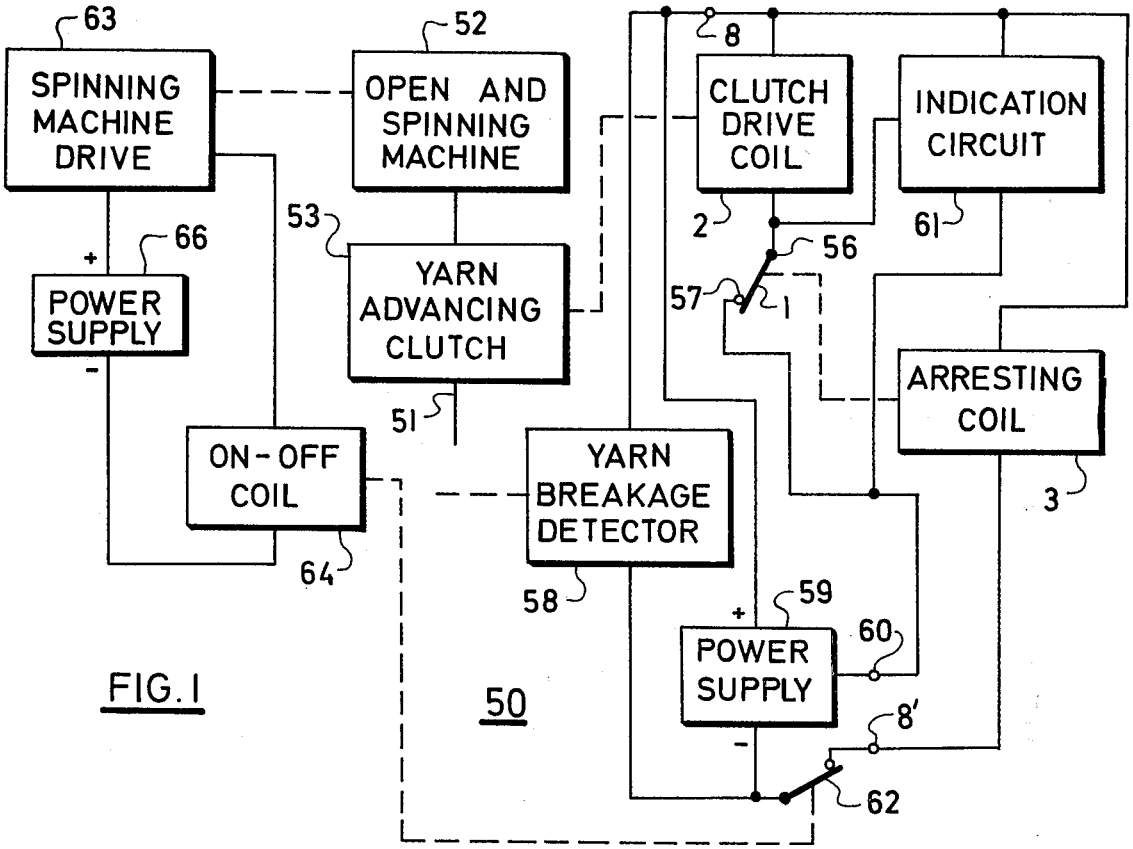
FIG. 1 is a block diagram of an overall circuit arrangement for detecting and indicating the breakage of a yarn in a knitting machine, and for simultaneously switching the conductive state of a drive coil-driven clutch that advances the yarn into the machine.

Referring now to the drawing, FIG. 1 illustrates an overall arrangement 50 for sensing and indicating the breakage of a yarn 51 which is advanced into a textile machine 52, illustratively an open end spinning machine. The yarn 51 is advanced by means of a clutch 53, illustratively a friction clutch, which is associated with a drive coil 2. The clutch 53 is of the type which is maintained operative to advance the yarn 51 so long as current is applied through its drive coil 2. The coil 2 is connected in series with a normally unoperated, magnetically operated switch 1, which may illustratively be a reed switch. The reed switch 1 is indicated by a pair of normally closed contacts 56, 57, which may be operated by means of a coil excitation path including a conventional yarn breakage detector 58. Such detector 58, which may be excited by means of a power supply 59, is adapted sense a breakage of the advancing yarn 51 and in response thereto to operate the normally conductive reed switch 1 into a non-conductive position.

The drive coil 2 is serially connected with the switch 1 across a pair of terminals 8, 60 of the power supply 59. Consequently, whenever the switch 1 is operated, the drive coil will be deenergized to stop the advance of the yarn 51. Simultaneously, an indication circuit 61, described in more detail below, will be energized to provide a visual indication of the yarn breakage.

In order to prevent the yarn advancing clutch from being energized when the spinning machine 52 is disabled, an arresting coil 3 is connected, via a normally closed, magnetically actuated switch 62, across a pair of terminals 8, 8' of the power supply 59. The arresting coil, like the yarn breakage detector 58, is adapted to operate the switch 1 into its non-conductive position whenever current is applied through the arresting coil 3. Such current is applied, in the arrangement shown, while a spinning machine drive 63 associated with the machine 52 is disabled, i.e., whenever no current flows through an on-off coil 64. Such coil 64, which is connected in series with the spinning machine drive 63 across a power supply 66, is adapted to operate the normally closed switch 62 into an open position whenever current flows through such coil 64, i.e., whenever the spinning machine 52 is operative.

Figure 2:
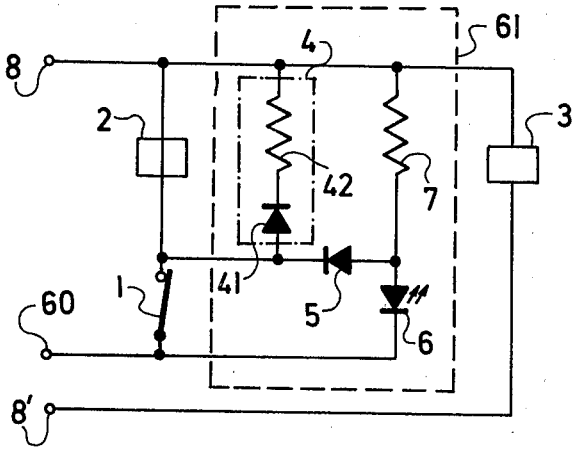
FIG. 2 is a combined block and schematic diagram of a portion of the circuit of FIG. 1 constructed in accordance with the invention for application when the yarn-advancing clutch is of the friction type.

FIG. 2 shows a first illustrative embodiment of the indication circuit 61, which is particularly adapted for use with a yarn-advancing clutch of the friction type, i.e., of the type which is normally operative when current is applied through its associated drive coil 2. A quenching circuit 4, which includes a resistor 42 serially connected with a diode 41, is connected across the normally energized clutch drive coil 2. The purpose of the quench circuit 4 is to absorb the energy of the coil 2 when the switch 1 is operated into its open position.

The indication circuit 61 further comprises an illumination device 6, which may be a lamp or a semiconductive photoelectric diode 6 serially connected with a resistor 7, whose resistance value determines the brightness of the illumination emitted by the element 6. The circuit path including the resistor 7 and the element 6 is connected across the circuit path including the drive coil 2 and the normally closed switch 1.

A diode 5 is connected between the junction of the resistor 7 and the element 6 and the junction of the drive coil 2 and the switch 1. The diode 5 is poled as indicated to bypass current from the element 6 whenever the coil 2, and thereby the associated friction clutch, is energized, i.e., whenever the switch 1 remains unoperated. Upon the detection of a yarn breakage and the consequent operation of the switch 1, current through the coil 2 is interrupted to disable the yarn feed by the associated clutch, and the remaining energy in the coil 2 is absorbed in the quench circuit 4. Simultaneously, current flows between the terminals 8 and 60 of the power supply 59 (FIG. 1) through the resistor 7 and the element 6, thereby causing the element 6 to be illuminated and to yield a visual indication of the yarn breakage.

It will be noted from the above that a single element, i.e., the magnetically operated switch 1, is effective when operated to both yield an indication of the yarn breakage and also to disable the yarn-advancing mechanism until repairs can be made.

The diode 5 is effective not only to maintain the element 6 deenergized until the switch 1 is operated, but also to decouple the element 6 from surges applied through the quenching circuit 4.

Figure 3:
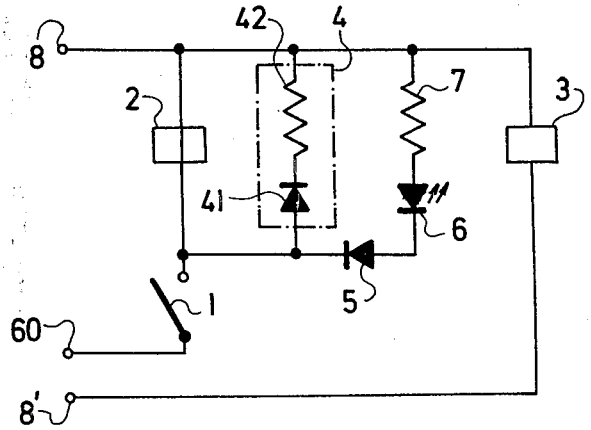
FIG. 3 is a combined block and schematic diagram of a modification of the circuit portion of FIG. 2 for application when the yarn-advancing clutch is of the claw type.

A modification of the arrangement of FIG. 2 is indicated in FIG. 3. The arrangement of FIG. 3 is adapted for operation with a claw-type clutch whose associated drive coil 2 is maintained deenergized until the occurrence of a yarn breakage. For this purpose, the switch 1 is normally disposed in an open condition, thereby isolating the coil 2 from excitation by the power supply 59 (FIG. 1) via the terminals 8, 60. In this case, the diode 5 is serially connected with the illumination path 6, 7 across the normally deenergized coil 2, the resulting parallel connection being coupled in series with the normally open switch 1.

In the arrangement of FIG. 3, the diode 5 is again poled to permit excitation of the illumination element 6 upon the occurrence of a yarn breakage, i.e., upon the resulting operation of the switch 1 into a conductive position. The operation of the switch 1 is simultaneously effective to close an excitation path through the clutch coil 2 via the terminals 8, 60, thereby stopping the feed of yarn through the associated claw clutch.

The connection and operation of the quenching circuit 4 and the arresting coil 3 in the arrangement of FIG. 3 is identical to that described above in connection with FIG. 1 and/or FIG. 2.

In the foregoing, several arrangements of the inventive circuit have been described. Many variations and modifications will now occur to those skilled in the art. It is accordingly desired that the scope of the appended claims not be limited to the specific disclosure herein contained.

What is claimed is:

1. In a circuit for indicating a yarn breakage in a knitting machine and for simultaneously switching the conductive state of a drive coil associated with a yarn drive element of the machine, a first path including magnetically actuated means serially connected with the drive coil for switching the conductive state of the coil when the switching means are operated, means responsive to a yarn breakage of the machine for magnetically operating the switching means from a first state to a second state, normally disabled indication means, and a diode coupled to the indication means and to the first path for maintaining the indication means disabled while the switching means remain unoperated and for enabling the indication means when the switching means are operated.

2. A circuit as defined in claim 1, in which the indication means comprises a second circuit path including illumination means serially connected with a resistor.

3. A circuit as defined in claim 2, in which the illumination means is a lamp.

4. A circuit as defined in claim 2, in which the first and second states of the switching means are respectively conductive and non-conductive, in which the second path is serially connected across the first path, and in which the diode is connected between a first junction of the illumination means and the resistor and a second junction of the drive coil and the switching means.

5. A circuit as defined in claim 2, in which the first and second states of the switching means are respectively non-conductive and conductive, and in which the diode is serially connected with the second path across the drive coil.

* * * * *